US005136948A

United States Patent [19]

Fujino et al.

[11] Patent Number: 5,136,948

[45] Date of Patent: Aug. 11, 1992

[54] MARKING METHOD AND APPARATUS

[75] Inventors: Noboru Fujino; Tohru Takamura, both of Tokyo, Japan

[73] Assignee: Kabushiki Kaisha Shinkawa, Tokyo, Japan

[21] Appl. No.: 607,316

[22] Filed: Oct. 31, 1990

[51] Int. Cl.[5] ..... B41L 3/08

[52] U.S. Cl. ..... 101/486; 101/382.1; 101/DIG. 36; 33/621; 358/107

[58] Field of Search ..... 101/DIG. 36, 382.1, 101/316, 485, 486; 33/613-621, 1 M, 645; 358/107

[56] References Cited

U.S. PATENT DOCUMENTS

| | | | |
|---|---|---|---|
| 4,520,389 | 5/1985 | Hornschuh | 33/617 |
| 4,641,244 | 2/1987 | Wilson et al. | 358/107 |
| 4,972,311 | 11/1990 | Holdgrafer et al. | 358/107 |
| 5,031,334 | 7/1991 | Takamura | 33/621 |

FOREIGN PATENT DOCUMENTS

| | | | |
|---|---|---|---|
| 0049218 | 3/1986 | Japan | 101/486 |

*Primary Examiner*—Edgar S. Burr
*Assistant Examiner*—Christopher A. Bennett
*Attorney, Agent, or Firm*—Koda and Androlia

[57] ABSTRACT

In performing markings in semiconductor manufacturing devices, the positional discrepancy between printing plate and plate holder is first detected by a camera. After correcting such a discrepancy, the printing plate is positionally fixed and then printing is performed. The printing plate is rotated and moved horizontally in any directions when positional discrepancy is detected and corrected, and an image signal of such positional discrepancy supplied from the camera which is set to face the plate holder is processed to be shown on a monitor for executing correction of the discrepancy.

2 Claims, 3 Drawing Sheets

FIG. 2
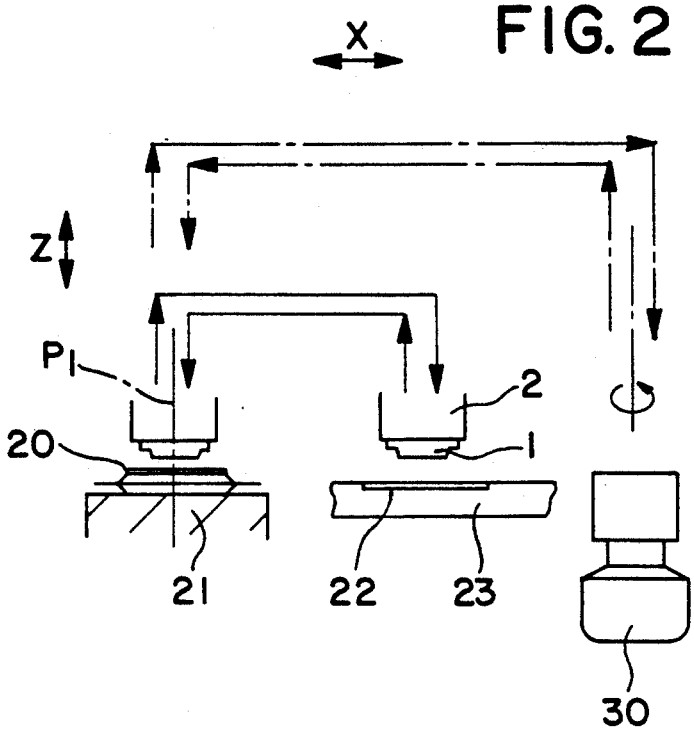
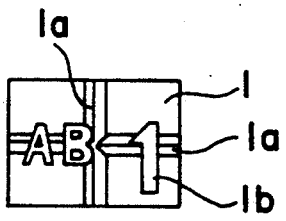
FIG. 3(a)
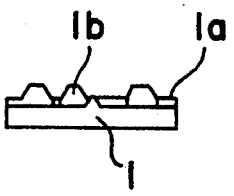
FIG. 3(b)

MARKING METHOD AND APPARATUS

BACKGROUND OF THE INVENTION

1. Field of the Invention

The present invention relates to a marking method and apparatus that uses relief plate printing.

2. Prior Art

In marking devices used for, for example, semiconductor devices, a two-sided tape is adhered to a plate holder, and printing plate used for relief-plate printing is bonded to the two-sided tape by an operator using tweezers, etc.

In this case, since the operator performs the bonding visually, positional discrepancy may occur between the printing plate and the plate holder. Such a positional discrepancy is corrected in the following manner: printing is first performed, the positional discrepancy of the printing plate is checked, the printing plate is removed from the plate holder, positional correction is made, and then the printing plate is bonded back to the plate holder.

In this conventional technique, the printing plate is repeatedly re-bonded as long as the positional discrepancy of the plate exists. The correction of the positional discrepancy takes time. Thus, the bonding condition may be deteriorated. In addition, dirt may be trapped between the printing plate and the plate holder.

SUMMARY OF THE INVENTION

Accordingly, a primary object of the present invention is to provide a marking method and apparatus which makes it possible to correct the positional discrepancy of the printing plate very easily and in a short period of time.

The marking method of the present invention includes the following steps: the positional discrepancy between a plate holder and a printing plate attached to the plate holder is first photographed by a camera. Next, the discrepancy between the two members is corrected, then the plate holder is aligned with a workpiece that is to be printed, and lastly printing is performed.

The marking apparatus which accomplishes the object of the present invention includes: a plate holder to which a printing plate is attached; a rotating means which rotates the plate holder; an XYZ direction driving means which moves the plate holder in X, Y and Z directions; a camera which is installed so as to face the attachment surface of the plate holder at a position removed from a workpiece carrying table which positions and carries the workpiece to be printed; an image processor which processes image signals from the camera; and a monitor which displays images in accordance with the output of the image processor.

In the marking method, the positional discrepancy between the printing plate and the plate holder is detected by the camera. The printing plate is positioned by correcting this positional discrepancy and then placed above the workpiece.

In the marking apparatus, the printing plate is rotated in the $\theta$ direction by the rotating means and moved in the X, Y and Z directions by the XYZ direction driving means. Accordingly, positioning of the printing plate is accomplished by installing the plate holder above the camera, moving the plate holder and camera relative to each other so that the positional discrepancy between the printing plate and the plate holder is detected, and then positioning the plate holder above the workpiece with the positional discrepancy in consideration.

BRIEF DESCRIPTION OF THE DRAWINGS

FIG. 2 is an explanatory diagram which illustrates the printing operation and correcting operation of positional discrepancy of the printing plate;

FIG. 3 illustrates the printing plate wherein FIG. 3(*a*) is a top view of the surface of the printing plate, and FIG. 3(*b*) is a front view thereof;

DETAILED DESCRIPTION OF THE INVENTION

One embodiment of the present invention will be described with reference to the accompanying drawings.

Figure 1:
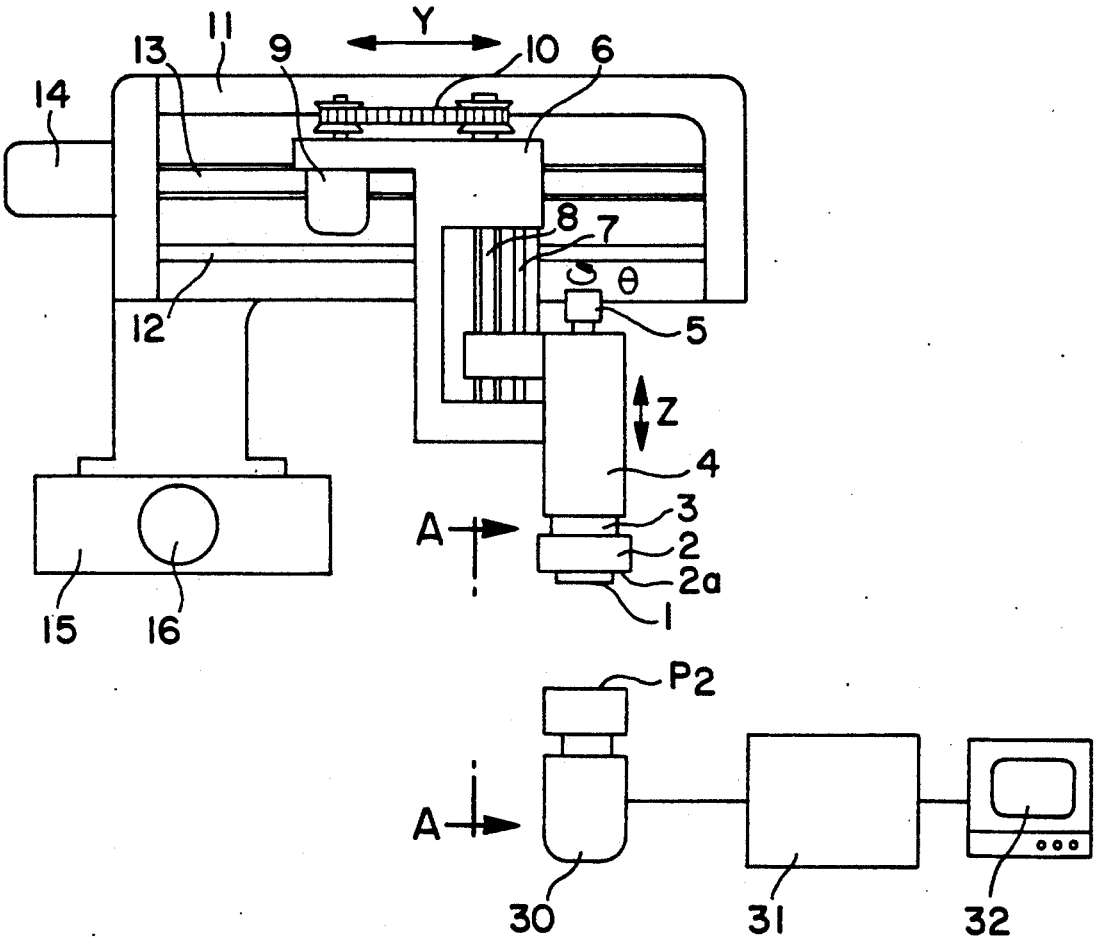
FIG. 1 is a schematic front view of the marking apparatus in accordance with one embodiment of the present invention.
Figure 4A:
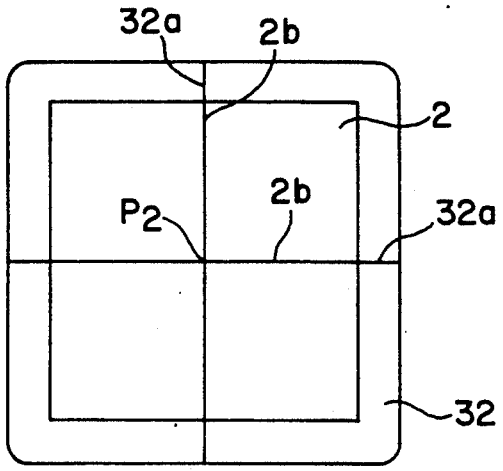
FIGS. 4(*a*), 4(*b*), 4(*c*) and 4(*d*) explain the method of discrepancy correction in accordance with the present invention.
Figure 4B:
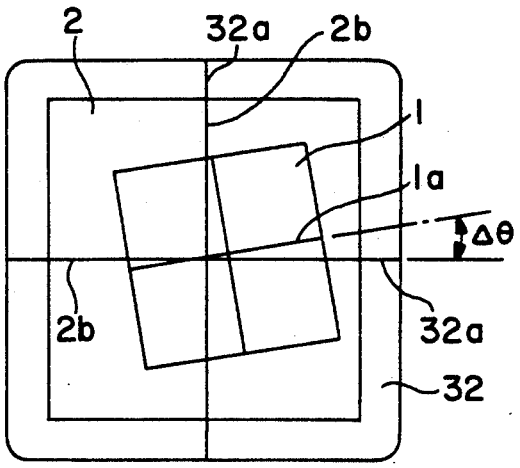
Figure 4C:
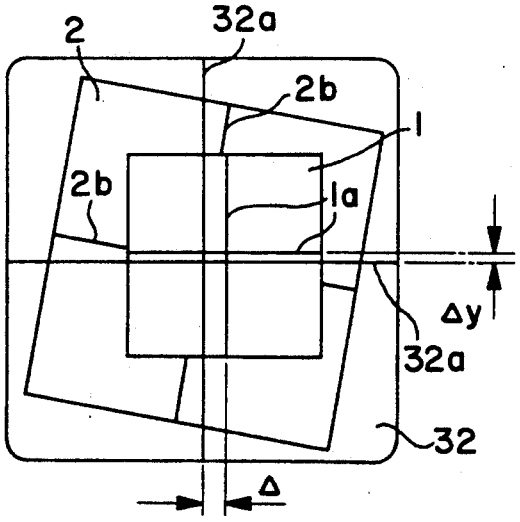
Figure 4D:
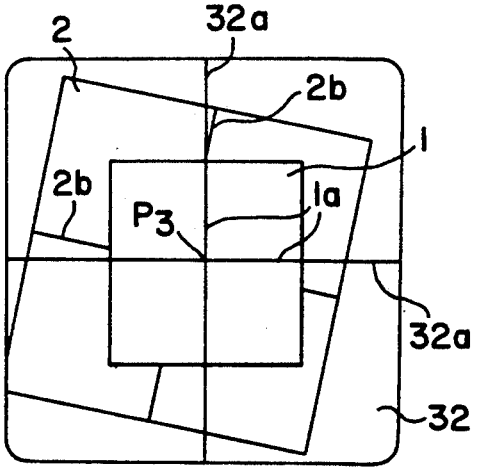

As shown in FIG. 1, a printing plate 1 made of a rubber stamp, for example, is bonded to a plate holder 2. The plate holder 2 is detachably attached to a rotary shaft 3. This rotary shaft 3 is rotatable on a first moving table 4 and is caused to rotate by a $\theta$-directional driving motor 5 mounted on the top of the first moving table 4.

The first moving table 4 is installed upright on a second moving table 6 and engaged with a Z-direction feed screw 8. The feed screw 8 is parallel to the guide rod 7 on the second moving table 6 so that the feed screw 8 is free to rotate.

The Z-direction feed screw 8 is driven via a belt 10 by a Z-direction driving motor 9 mounted on the second moving table 6. The second moving table 6 can slide on a guide rod 12 which is installed in the horizontal Y direction on a third moving table 11.

The second moving table 6 engages with a Y-direction feed screw 13 which is parallel to the guide rod 12 on the third moving table 11 so that the feed screw 13 is free to rotate. The Y-direction feed screw 13 is driven by a Y-direction driving motor 14 which is fixed to the third moving table 11. The third moving table 11 can slide in the horizontal X direction on a base 15 and is driven via an X-direction feed screw (not shown) by an X-direction driving motor 16 that is fastened to the base 15.

When the $\theta$-direction driving motor 5 is driven, the plate holder 2 is caused to rotate in the $\theta$-direction. When the Z-direction driving motor 9 is driven, the Z-direction feed screw 8 is rotated via the belt 10 so that the plate holder 2 moves in the Z-direction along with the first moving table 4. When the Y-direction driving motor 14 is driven, the second moving table 6 is moved in the Y direction by the Y-direction feed screw 13 so that the plate holder 2 moves in the Y direction. Similarly, when the X-direction driving motor 16 is driven, the third moving table 11 is moved in the X direction, so that the plate holder 2 is also caused to move in the X direction.

As is shown in FIG. 2, an ink stand 23 containing ink 22 is installed at a position away, in the X direction, from the position of a workpiece carrying table 21 on which the workpiece 20 that is to be printed is positioned and carried.

Printing is accomplished by repeating the actions indicated by the solid lines in FIG. 2. Specifically, ink 22 is applied to the printing plate 1, the printing plate 1 is moved above the workpiece 20 and then lowered so that the workpiece 20 is printed. This process is accomplished by a combination of (a) the movements of the plate holder 2 in the Z direction driven by the Z-direction driving motor 9 and (b) the movements of the plate holder 2 in the X direction driven by the X-direction driving motor 16.

A camera 30 is installed with its imaging or photographing side facing up as shown in FIG. 1. The camera 30 is removed from or away from the position of the workpiece carrying table 21. Image signals from this camera 30 are processed by an image processor 31 and displayed on a monitor 32.

As shown in FIG. 4, on the attachment surface 2*a* of the plate holder 2 is formed beforehand with a cross-from standard lines 2*b*. Also, as shown in FIG. 3, positioning lines 1*a*, which are lower than the print characters 1*b*, in height, are formed on the printing plate 1.

Next, the method for correcting the positional discrepancy of the printing plate 1 in the above-described marking apparatus will be described with reference to FIG. 4. This correction is accomplished via the actions indicated by one-dot chain lines in FIG. 2.

Regular coordinates at the center of the plate holder 2, when the plate holder 2 is positioned above the workpiece 20 (in a case where the workpiece 20 on the workpiece carrying table 21 is to be marked), are designated as $P_1$ ($x_1$, $y_1$). As for the X and Y axes at the center of the camera 30, a cross-form reticule 32*a* is displayed by the monitor 32 as shown in FIG. 4 (*a*).

First, without the plate 1, the Y-direction driving motor 14 and X-direction driving motor 16 are driven so that the plate holder 2 is positioned directly above the camera 30.

Next, the X-direction driving motor 9 is driven so that the standard lines 2*b* on the plate holder 2 are matched to the focal point of the camera 30. Then, the $\theta$-direction driving motor 5 is driven so that the standard lines 2*b* on the plate holder 2 are aligned with the reticule 32*a* on the display surface of the monitor 32. The coordinates of the centerlines of the standard lines 2*b* on the plate holder 2 in this case are designated as $P_2$ ($x_2$, $y_2$).

The alignment of the standard lines 2*b* with the reticule 32*a* can be accomplished by an operator manually operating a prior art electrical chessman (not shown) so that the motors 16, 14, 9 and 5 are driven. The coordinates $x_2$, $y_2$ can be detected by driving the X-direction driving motor 16 and Y-direction driving motor 14. The Z coordinate can be detected by driving the Z-direction driving motor 9. Also, the $\theta$ coordinate can be detected by driving the $\theta$-direction driving motor 5. These coordinates $P_2$ ($x_2$, $y_2$, z, $\theta$) are saved in an arithmetic circuit (not shown).

Next, the plate holder 2 is moved to an arbitrary position where work can easily be accomplished. Then, the plate holder 2 is removed from the rotary shaft 3, and the printing plate 1 is bonded to the attachment surface 2*a* of the plate holder 2. Bonding is performed after the positioning lines 1*a* on the printing plate 1 are aligned with the standard lines 2*b* on the plate holder 2. However, since the bonding is performed by hand, a positional discrepancy of approximately 0.3 mm in the X and Y directions and a positional discrepancy of approximately 0.5 degrees in the $\theta$ direction are unavoidable.

The plate holder 2 is again attached to the rotary shaft 3, and the plate holder 2 is moved to the position represented by the coordinates $P_2$ ($x_2$, $y_2$, z, $\theta$). The, the condition of the printing plate 1 is again shown on the display surface of the monitor 32 (FIG. 4 (*b*)).

In this case, since the bonded printing plate 1 necessarily has a positional discrepancy, the positioning lines 1*a* formed on the printing plate 1 is shifted relative to the reticule 32*a* on the monitor 32. Therefore, the plate holder 2 is first rotated by the $\theta$-direction driving motor 5 so that the discrepancy in the rotational direction is corrected (FIG. 4 (*c* )). This operation is performed using an electrical chessman, and the amount of correction ($\Delta\theta$) is saved.

Similarly, the discrepancies $\Delta x$ and $\Delta y$ in the horizontal plane are corrected by the X-direction driving motor 16 and Y-direction driving motor 14, and the coordinates $P_3$ ($x_3$, $y_3$) in this case are saved (FIG. 4 (*d*)).

Accordingly, the discrepancies $\Delta x$ and $\Delta y$ can be shown as follows:

$$\Delta x = x_2 - x_3$$

$$\Delta y = y_2 - y_3$$

Then, the coordinates P (x, y) at the time that printing is performed on the workpiece 20 can be shown as follows:

$$x = x_1 + \Delta x$$

$$y = y_1 + \Delta y$$

These coordinates are processed by an arithmetic circuit (not shown).

Next, with the state correction is made as shown in FIG. 4 (*d*), the X-direction driving motor 16 and Y-direction motor 14 are driven so that the plate holder 2 is positioned at the coordinates P (x, y). Thereafter, the printing plate 1 is pressed against the workpiece 20 by the vertical motion of the plate holder 2, thus printing is performed.

When the plate holder 2 is moved from a position above the camera 30 to a position above the workpiece 20 as described above, positioning is performed with the saved discrepancies $\Delta x$ and $\Delta y$ added as a correction value. As a result, the positional discrepancy of the printing plate 1 does not appear as a discrepancy in the printing position.

In the present invention, as is clear from the above description, the positional discrepancy between printing plate and plate holder are detected by causing the plate holder and a camera to move relative to each other. Also, once the printing plate is bonded, there is no need for re-bonding. Accordingly, the work can be accomplished very easily and in a very short period of time.

We claim:

1. A marking method comprising the ordered steps of photographing a positional discrepancy between a plate holder and a printing plate attached to said plate holder by a camera, correcting said discrepancy between said plate holder and printing plate, aligning said plate holder with a work piece that is to be printed, and performing printing.

2. A marking apparatus characterized in that said apparatus comprises: a plate holder to which a printing plate is attached, a rotating means which rotates said plate holder, an XYZ driving means which moves said plate holder in the X, Y and Z directions, a camera installed so as to face an attachment surface of said plate holder at a position away from a workpiece carrying table which positions and carries said workpiece that is to be printed, an image processor which processes said image signals provided from said camera, and a monitor which displays images in accordance with output of said image processor.

* * * * *